United States Patent [19]

Price

[11] 4,298,910

[45] Nov. 3, 1981

[54] ROLLER SKATE WHEEL WITH SELF-CONTAINED GENERATOR

[75] Inventor: Robert T. Price, Canoga Park, Calif.

[73] Assignee: RJM Industries, Inc., Franklin, Wis.

[21] Appl. No.: 122,674

[22] Filed: Feb. 19, 1980

[51] Int. Cl.[3] ..... F21L 13/00

[52] U.S. Cl. ..... 362/35; 280/11.19; 280/809; 301/5.7; 310/73; 362/103; 362/806

[58] Field of Search ..... 280/809, 811, 816, 11.19, 280/87.04 A, 87.04 R, 87.01; 180/65 F; 301/5.7, 5.3, 37 N; 310/67 A, 67 R, 73; 340/52 R; 362/35, 72, 78, 103, 806, 157, 184, 192

[56] References Cited

U.S. PATENT DOCUMENTS

| | | | |
|---|---|---|---|
| 754,802 | 3/1904 | Porsche et al. | 180/65 F |
| 2,152,685 | 4/1939 | Grange et al. | 301/5.7 |
| 2,931,012 | 3/1960 | Kosach | 280/809 X |

FOREIGN PATENT DOCUMENTS

| | | | |
|---|---|---|---|
| 1112759 | 11/1955 | France | 310/67 A |
| 621382 | 4/1949 | United Kingdom | 301/5.7 |

*Primary Examiner*—Joseph F. Petres, Jr.
*Assistant Examiner*—D. W. Underwood
*Attorney, Agent, or Firm*—Ralph B. Pastoriza

[57] ABSTRACT

A roller skate wheel has an inner body portion for securement to the axle of the roller skate and an outer body rotatable about the inner body on appropriate bearings. A permanent magnet is secured to the inner body in flux coupling relationship with electrically conducting windings carried on the outer body. When the wheel rotates, electricity is generated on the windings and used to energize light emitting diodes carried on the outer body of the wheels. The generated electricity is of the alternating type and since the light emitting diodes are essentially polarity-sensitive, they will be energized on only positive half cycles of the current to thereby provide a flashing or stroboscopic effect.

4 Claims, 3 Drawing Figures

ROLLER SKATE WHEEL WITH SELF-CONTAINED GENERATOR

This invention relates generally to roller skates and more particularly to a roller skate wheel with a self-contained generator for automatically providing electrical energy whenever the roller skate is in use, causing the wheel to rotate.

BACKGROUND OF THE INVENTION

It is known to provide lights on roller skates to illuminate them at night. In fact, roller skates provided with flashing lights for disco dancing and the like have been proposed. In all such instances, so far as I am aware, batteries have been necessary to energize the lights. In some instances, the batteries may actually be carried by the skater himself with appropriate wires leading to light bulbs on the roller skates. In other instances, the batteries can be incorporated in a case carrying a light bulb similar to a flashlight, the entire unit being secured in turn to the roller skate.

While the provision of a small flashlight type structure which can simply be strapped or clipped to a roller skate is a fairly economical means of providing lights for a roller skate, there still is required some type of clamp or structure on the skate itself which requires a modification of the skate in order to support the light. In other instances where several light bulbs or light sources are utilized on a roller skate, extensive modification of the skate itself is necessary or an originally manufactured skate must be provided.

In all known embodiments of lights on roller skates, wherein batteries are utilized to energize the lights, there is the ever-present problem of having to periodically replace the batteries.

BRIEF DESCRIPTION OF THE PRESENT INVENTION

With the foregoing considerations in mind, the present invention contemplates a different arrangement for providing lights or other devices utilizing electrical energy on roller skates wherein problems associated with prior art systems as discussed heretofore are eliminated.

More particularly, in accord with the present invention, there is provided a roller skate wheel with a self-contained generator designed for substitution for a conventional roller skate wheel. The new wheel with the self-contained generator, in one embodiment, incorporates light emitting diodes for energization by the generator when the wheel is rotated. However, any device utilizing electrical energy could be energized by the generator such as a portable loudspeaker for generating sound.

More particularly, in its broadest aspect, the roller skate wheel of this invention includes a stationary body for securement to the axle of a roller skate, a rotatable body carried by the stationary body for rotation relative to the stationary body, a permanent magnet secured to one of the bodies, electrical conducting windings secured to the other of the bodies in flux coupling relationship with the magnet.

By this arrangement, relative rotation of the bodies generates an alternating current in the electrical windings. An electrical energy utilizing means such as a light bulb or light emitting type diode, is connected to the windings for energization thereby.

The foregoing arrangement neatly solves the two basic problems found in prior art skates, to wit, first, extensive modification of present skates to provide for lights, and second, the requirement for batteries to energize the lights.

With my present invention, it is only necessary to substitute one skate wheel for the other and all of the advantages of a skate with lights results. There is never any need to replace any batteries since the only time the light is utilized is when the skate is in use to generate the electricity for the lights.

BRIEF DESCRIPTION OF THE DRAWINGS

A better understanding of this invention will be had by now referring to a preferred embodiment thereof as illustrated in the accompanying drawings in which.

DETAILED DESCRIPTION OF THE PREFERRED EMBODIMENT

Figure 1:
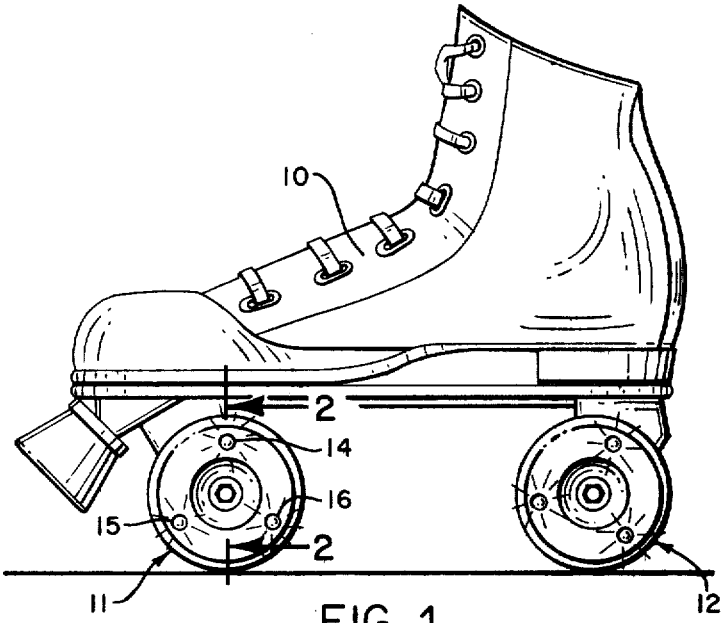
FIG. 1 is a side elevational view of a roller skate incorporating roller skate wheels with self-contained generators in accord with the present invention.

Referring first to FIG. 1, there is shown a roller skate 10 provided with substitute wheels 11 and 12 designed in accord with the present invention. The wheels 11 and 12 are identical and therefore a detailed description of one will suffice for both.

Thus, referring specifically to the wheel 11, there are indicated at 14, 15 and 16 three light emitting diodes spaced about the outboard side of the wheel as shown. One of these lights, such as the light emitting diode 14, for example, could be designed to emit yellow light while the remaining two lights 15 and 16 each emit red light. As will become clearer as the description proceeds, these lights will flash as the wheel 11 rotates so that a "stroboscopic" effect results.

Figure 2:
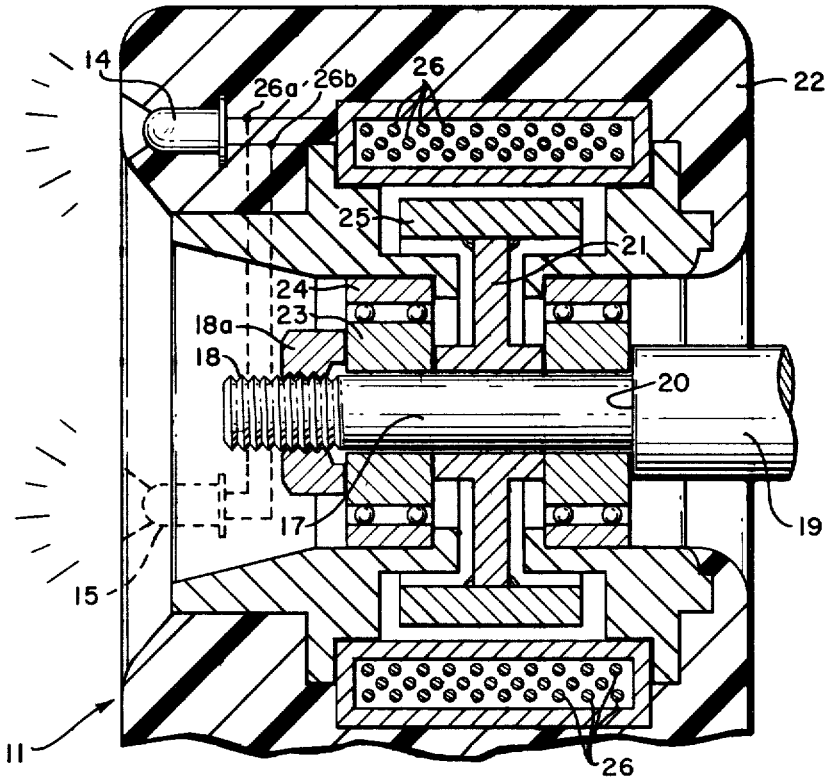
FIG. 2 is a greatly enlarged fragmentary cross section of one of the wheels taken in the direction of the arrows 2—2 of FIG. 1; and, FIG. 3 is a fragmentary schematic electrical circuit diagram illustrating the manner in which light emitting diodes are connected.

Referring now to the enlarged cross section of FIG. 2, details of the wheel 11 are shown.

A feature of the present invention is that the wheel is so designed as to be readily substituted for a conventional type wheel secured to the axle of the roller skate. In FIG. 2, the roller skate axle is shown at 17 provided with normal external threads 18 on its outer end and extending from the roller skate truck 19. An annular shoulder 20 is defined where the axle 17 extends from the truck portion 19.

Threads 18 on axle 17 normally receive a nut **18*a* for securing the skate wheel to the axle 17. With this arrangement, it is very simple to remove a conventional skate wheel and substitute the skate wheel 11** of the present invention.

Considering now specifically the skate wheel 11, the structure includes an inner body 21 secured to the axle 17 by means of the nut **18*a* and shoulder 20 which will sandwich the inner body 21 in a fixed position to the axle and truck. An outer body indicated generally at 22, in turn, is rotatably mounted to the inner body 21 as by appropriate inner and outer bearings 23 and 24**.

As shown in FIG. 2, there is provided a permanent magnet 25 secured to the inner stationary body 21. This permanent magnet is arranged to be in flux coupling relationship with appropriate electrically conducting windings 26 incorporated in the outer body 22 so that when the outer body 22 rotates relative to the inner stationary body, an alternating current will be generated in the windings 26.

The light emitting diodes such as the light emitting diode 14 referred to in FIG. 1 is shown embedded in the outer body 22 in FIG. 2 and connects to the outlet leads 26*a* and 26*b* from the windings 26. These same leads connect to the other light emitting diodes such as the light emitting diode 15 shown in phantom lines in FIG. 2, all as will become clearer by now referring to the schematic electrical diagram of FIG. 3.

Figure 3:
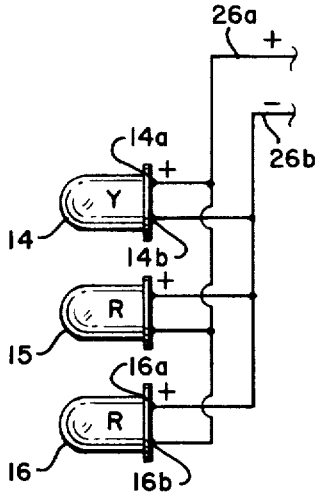

In FIG. 3, the output winding ends 26*a* and 26*b* are designated positive and negative respectively. This represents the polarity of these leads at one point during the generation of electricity resulting from rotation of the outer body relative to the inner body.

Each of the light emitting diodes 14, 15 and 16 has terminals which are polarized to the extent that the light will only be energized when current passes through the terminals in one direction. Thus, for the light emitting diode 14, the terminals are designated 14*a* and 14*b* and this light will be energized when terminal 14*a* is connected to lead 26*a* and lead 26*a* is positive as shown. When the polarity reverses on the leads 26*a* and 26*b*, then the light emitting diode 14 will turn off or be extinguished. Thus, light emitting dioded 14 will only flash on positive half cycles of the generated alternating current.

The remaining light emitting diodes 15 and 16 in the particular embodiment illustrated, have their terminals such as the terminals 16*a* and 16*b* for the diode 16 connected in a reverse manner to the leads 26*a* and 26*b*. In other words, the positive terminal 16*a* for the light emitting diode 16 connects to the winding end 26*b* from the windings so that light emitting diode 16 will be off or extinguished when light emitting diode 14 is on and light emitting diode 16 will be energized when light emitting diode 14 is off. The terminals for light emitting diode 15 are connected in a similar manner to those for the diode 16, so that diodes 15 and 16 will flash together out of phase with light emitting diode 14.

As described with respect to FIG. 1, light emitting diode 14 in the particular embodiment illustrated emits yellow light while light emitting diodes 15 and 16 emit red light. Since yellow light will normally appear visually brighter than a red light, there are provided two red lights for the one yellow light. When the wheel is rapidly rotating, the lights will flash rapidly and a stroboscopic effect will result, the various colors providing a unique and dazzling effect as the wheel rotates.

It is possible, of course, to utilize the generated electrical energy to operate other electrical utilizing devices such as a simple loudspeaker or sound generating instrument.

From all of the foregoing, it can now be appreciated that the present invention has provided a roller skate wheel which can be substituted for the conventional wheel on a roller skate without having to modify the conventional roller skate in any other manner except for the substitution. Further, because of the self-contained generator, no batteries whatsoever are required and thus the lights can be energized "indefinitely" so long as the wheel is rotating.

Various modifications and variations falling within the scope and spirit of this invention will occur to those skilled in the art. The roller skate wheel with self-contained generator is accordingly not to be thought of as limited to the exact construction set forth merely for illustrative purposes.

I claim:

1. A roller skate wheel including, in combination:

(a) an inner stationary body for securement to a roller skate axle;

(b) an outer body surrounding said inner stationary body;

(c) bearings rotatably mounting said outer body to said stationary body;

(d) at least two light emitting means incorporated in said outer body for emitting light from the outboard side of the outer body of said skate wheel when energized;

(e) a permanent magnet secured to said inner body; and (f) electrically conducting windings embedded in said outer body and connected to said light emitting means, said windings being in magnetic flux coupling relationship with said permanent magnet so that upon rotation of said outer body, alternating current is generated in said windings for energizing said light emitting means.

2. A roller skate wheel according to claim 1, each of said light emitting means is responsive to current passing through its terminals in only one direction so that it will alternately flash on and off as said outer body rotates.

3. A roller skate wheel according to claim 2, in which said light emitting means constitute light emitting diodes and wherein at least one of said light emitting means has its terminals connected to said windings in a sense opposite to another of said light emitting means so that it will flash on while said another light emitting means is off and will turn off when said another light emitting means is flashing on.

4. A roller skate wheel according to claim 3, in which at least two of said light emitting means emit light of different color.

* * * * *